US011014641B1

(12) United States Patent
Marcaccio et al.

(10) Patent No.: US 11,014,641 B1
(45) Date of Patent: May 25, 2021

(54) WEARABLE FLOTATION DEVICE

(71) Applicant: Aerial Machine & Tool Corporation, Meadows of Dan, VA (US)

(72) Inventors: John Douglas Marcaccio, Mt. Airy, NC (US); Matthew Stuart Wade, Ridgeway, VA (US); Matthew Perry Jennings, Laurel Fork, VA (US); Brandon Ty Hinkley, Woodlawn, VA (US)

(73) Assignee: Aerial Machine & Tool Corporation, Meadows of Dan, VA (US)

( * ) Notice: Subject to any disclaimer, the term of this patent is extended or adjusted under 35 U.S.C. 154(b) by 0 days.

(21) Appl. No.: 16/715,740

(22) Filed: Dec. 16, 2019

Related U.S. Application Data

(60) Provisional application No. 62/933,807, filed on Nov. 11, 2019.

(51) Int. Cl.
*B63C 9/125* (2006.01)
*B63C 9/00* (2006.01)

(52) U.S. Cl.
CPC ..... *B63C 9/1255* (2013.01); *B63C 9/00* (2013.01)

(58) Field of Classification Search
CPC .. B63C 9/00; B63C 9/08; B63C 9/125; B63C 11/00; B63C 11/02; B63C 9/1255; B63C 9/155; B63C 9/16
USPC ..... 441/88, 106, 118, 119; 405/185, 186
See application file for complete search history.

(56) References Cited

U.S. PATENT DOCUMENTS

| | | | |
|---|---|---|---|
| 3,266,070 | A | 8/1966 | O'Link |
| 3,475,774 | A | 11/1969 | Hawkins |
| 3,602,463 | A | 8/1971 | Koochembere |
| 3,681,801 | A | 8/1972 | Bel |
| 3,771,183 | A | 11/1973 | Moran |
| 3,910,457 | A | 10/1975 | Sutliff et al. |
| 3,957,231 | A | 5/1976 | Miller et al. |
| 4,097,947 | A | 7/1978 | Kiefer |
| 4,623,316 | A | 11/1986 | Ratliff |
| 4,793,575 | A | 12/1988 | Butler |
| 4,925,133 | A | 5/1990 | Wurst et al. |
| 5,072,727 | A | 12/1991 | Aronne |
| 5,095,957 | A | 3/1992 | Herman |
| 5,295,765 | A | 3/1994 | Choi |
| 5,318,018 | A | 6/1994 | Puma et al. |
| 5,692,933 | A | 12/1997 | Bradley et al. |
| 5,759,076 | A | 6/1998 | Bateman et al. |
| 6,108,816 | A | 8/2000 | Bradley |

(Continued)

FOREIGN PATENT DOCUMENTS

| | | | |
|---|---|---|---|
| GB | 2407067 | A | 4/2005 |
| WO | 2005002674 | A2 | 1/2005 |

OTHER PUBLICATIONS

I375 Inflata-Belt™ Max Manual Inflatable Belt Pack, accessed on or before Sep. 23, 2019, <https://www.coleman.com/i375-inflata-belt-max-manual-inflatable-belt-pack/I375-.html>.

(Continued)

*Primary Examiner* — Lars A Olson
(74) *Attorney, Agent, or Firm* — Banner & Witcoff, Ltd.

(57) ABSTRACT

A wearable personal flotation device may be configured for wear under a parachute harness and may comprise a rear section and a pair of side sections that extend forward from lower sides of the rear section. A bladder may be contained in the rear and side sections and, when inflated, may expand through release gaps in fronts of the side sections. The rear section may include a panel of closed cell foam.

26 Claims, 15 Drawing Sheets

(56) References Cited

U.S. PATENT DOCUMENTS

| | | | |
|---|---|---|---|
| 6,233,740 | B1 | 5/2001 | Meyers et al. |
| 6,589,088 | B1 | 7/2003 | Maness |
| 6,766,535 | B2 | 7/2004 | Duhamell et al. |
| 6,824,106 | B2 | 11/2004 | Douglas et al. |
| 6,837,764 | B2 | 1/2005 | Bradley |
| 6,857,136 | B1 | 2/2005 | Bradley et al. |
| 6,942,630 | B2 | 9/2005 | Behan |
| 7,182,662 | B2 | 2/2007 | O'Meara et al. |
| 7,824,239 | B2 | 11/2010 | Weinel et al. |
| 8,920,205 | B2 | 12/2014 | McCarthy |
| 9,045,206 | B2 | 6/2015 | Flythe, Jr. et al. |
| 2008/0311808 | A1 | 12/2008 | Oneill et al. |

OTHER PUBLICATIONS

"RESTUBE Basic Flotation Gear Belt", www.chutingstar.com (May 10, 2018), <https://web.archive.org/web/20180510090135/http://www.chutingstar.com/restube-basic-flotation-gear-belt>.

"Integration Supporting Unintentional Water Landings", www.dla.mil (Nov. 29, 2018), <https://www.dla.mil/Portals/104/Documents/TroopSupport/CloTex/2018%20JAPBI/Personal%20Flotation%20Device.pdf?ver=2018-12-27-172436-107>.

Picture of AIRSAVE CMU-33 aircrew survival vest (prior to Aug. 9, 2013).

GI Army Airborne B-7 Parachutist Life Preserver Army Navy Sales, <https://www.armynavysales.com/gi-army-airborne-b-7-prachutist-life-preserver.html>, printed Sep. 25, 2019, 5 pages.

WEARABLE FLOTATION DEVICE

CROSS REFERENCE TO RELATED APPLICATION

This application claims priority to U.S. provisional patent application No. 62/933,807, titled "Wearable Flotation Device," and filed Nov. 11, 2019. Application No. 62/933,807, in its entirety, is incorporated by reference herein.

BACKGROUND

Parachutists may, intentionally or unintentionally, sometimes land in the ocean, a lake, a river, or other body of water. If there is a risk of a water landing, a parachutist may sometimes wear a flotation device. Prior to jumping, a parachute is typically held in a container such as a pack that is secured to a parachutist's back via a harness comprising multiple straps. There is often limited space on a parachutist's body to wear a flotation device.

This lack of space for a flotation device may be even more acute in the case of military parachutists (e.g., airborne combat soldiers) and/or specialized civilian parachutists (e.g., smoke jumpers). Such personnel often carry substantial additional equipment. An airborne combat soldier, for example, may carry a reserve parachute, an equipment pack, a weapon, and/or other equipment secured to the front side of the soldier's body.

One existing type of parachutist emergency flotation device comprises a pair of pouches that are secured under a parachutist's armpits using a set of shoulder straps. The pouches contain bladders that may be inflated to provide flotation if a wearer enters the water. This type of device, which includes devices such as the U.S. Air Force B-7 flotation device and the U.S. Navy LBU 10/P flotation device, suffers various shortcomings. Because the buoyancy bladders are held in pouches secured under a wearer's armpits, the deflated sizes of those bladders must be limited to avoid wearer discomfort and/or loss of mobility. As a result, the amount of buoyancy that can be provided by these types of existing devices is limited. Another shortcoming of these existing devices relates to positioning of the bladders when inflated. In particular, the inflated bladders may be positioned under the wearer's arms. This may tend to push the wearer's arms outward and/or otherwise limit the wearer's ability to move his or her arms. Such loss of mobility may be dangerous if a parachutist is attempting to perform life-critical operations (e.g., trying to separate from a parachute to avoid entanglement and/or drowning) after entering the water.

SUMMARY

This Summary is provided to introduce a selection of some concepts in a simplified form as a prelude to the Detailed Description. This Summary is not intended to identify key or essential features.

A flotation device may comprise a rear section and a pair of side sections. The side sections may extend forward from lower sides of the rear section. The flotation device may comprise a strap system that secures the rear section in place over a wearer's back, with the side sections positioned at the wearer's sides below armpit level. A bladder may be contained in the rear and side sections in a folded and at least partially deflated state. When inflated, lobes of the bladder may expand through release gaps in fronts of the side sections. The rear section may include a panel of closed cell foam.

These and other features are described in more detail below.

BRIEF DESCRIPTION OF THE DRAWINGS

Some features are shown by way of example, and not by way of limitation, in the figures of the accompanying drawings and in which like reference numerals refer to similar elements.

DETAILED DESCRIPTION

Figure 1A:
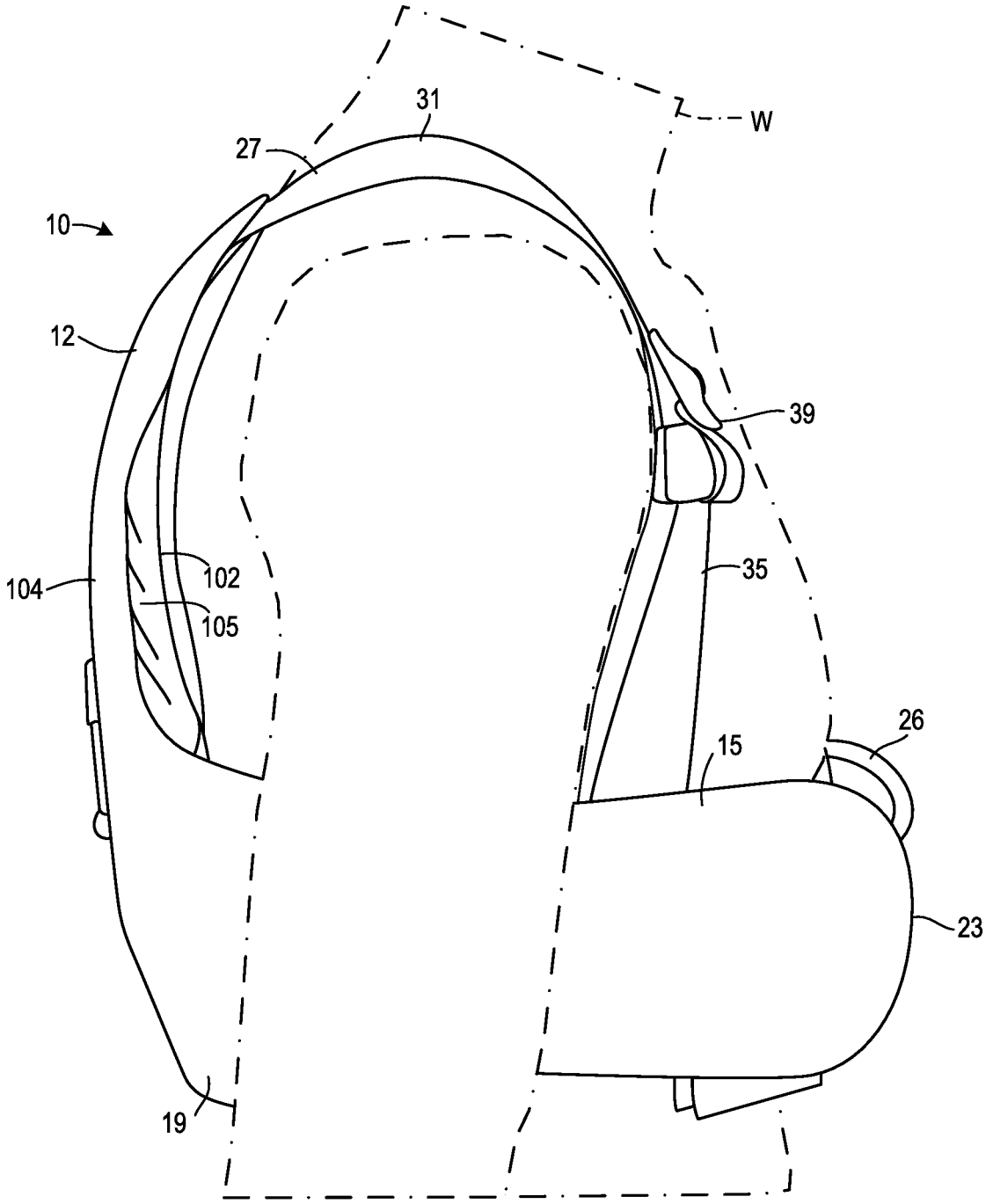
FIGS. 1A and 1B show a right side of an example wearable personal flotation device in an as-worn, undeployed condition.
Figure 1B:
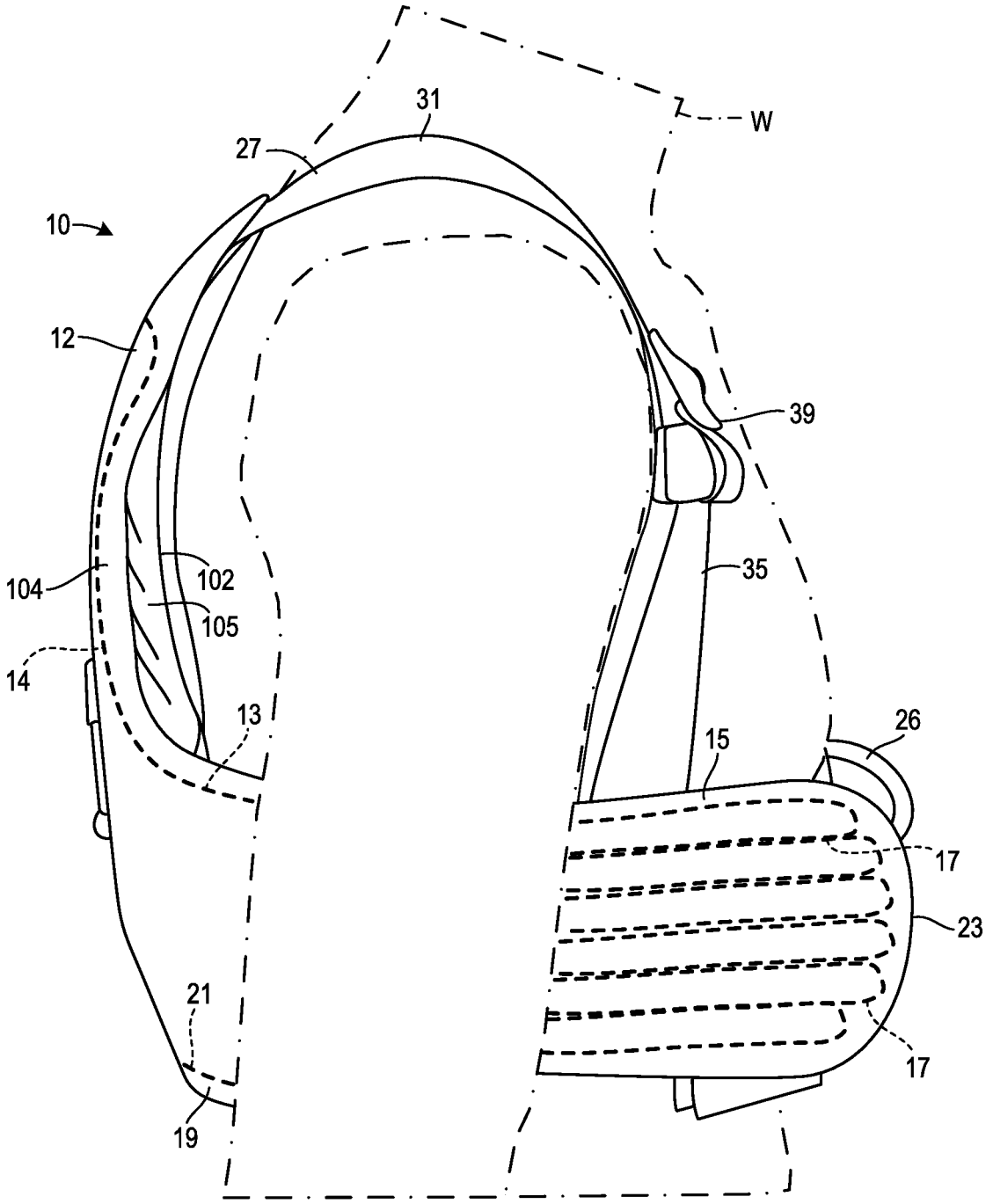

FIGS. 1A and 1B show a right side of an example wearable personal flotation device 10. The flotation device 10 is configured for wear on a torso of a human. In FIG. 1A and subsequent figures, and to avoid unnecessarily obscuring the drawings with unneeded details, relevant portions of a wearer W of the flotation device 10 are shown as uneven broken line silhouettes. The flotation device 10 may be worn under a parachute harness and/or under other equipment that the wearer W may be wearing and/or carrying. To avoid obscuring the drawings, a parachute harness and other equipment are omitted.

Figure 2A:
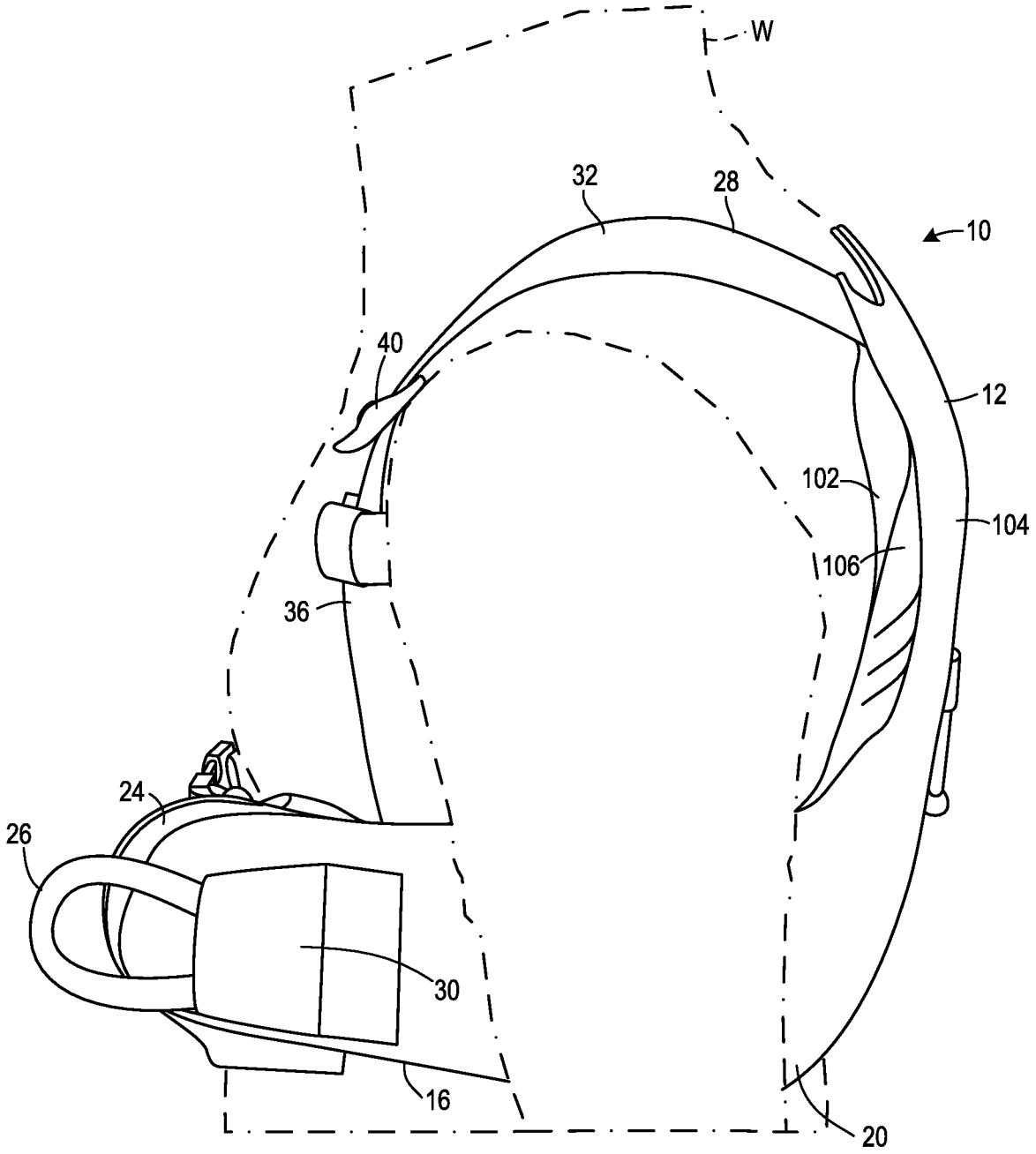
FIGS. 2A and 2B show a left side of the flotation device of FIGS. 1A and 1B in an as-worn, undeployed condition.
Figure 2B:
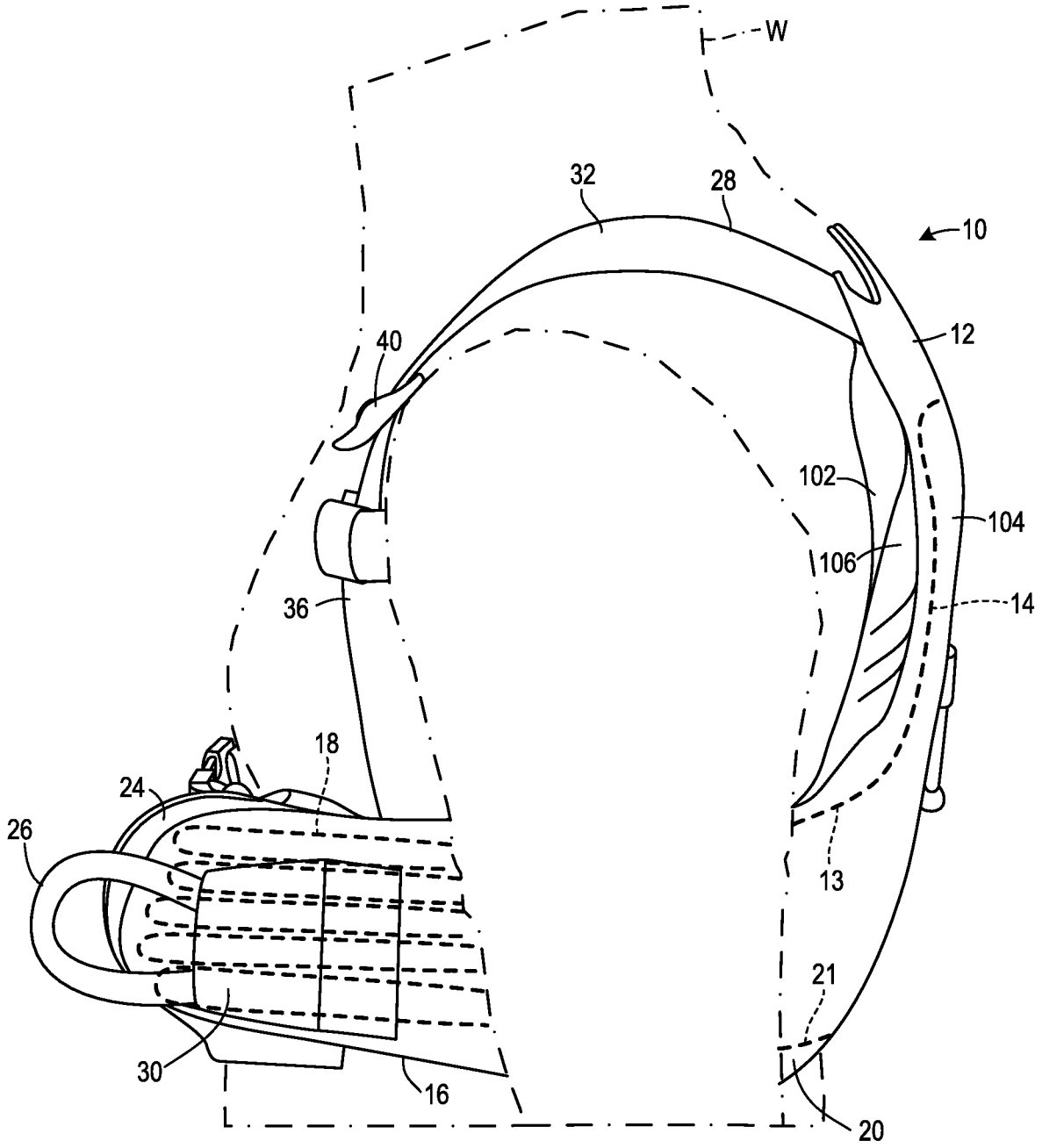
Figure 3:
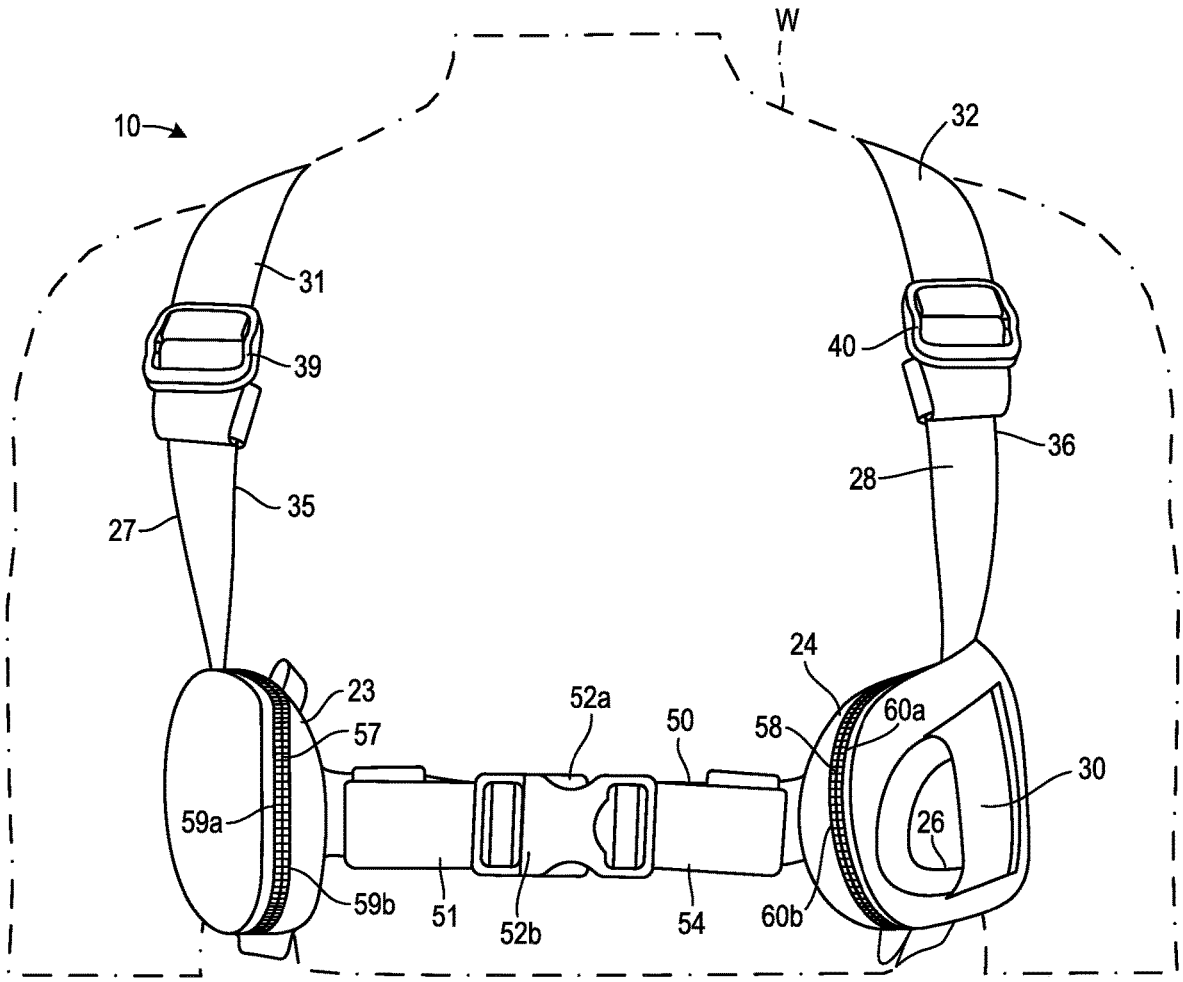
FIG. 3 shows a front of the flotation device of FIGS. 1A and 1B in an as-worn, undeployed condition.
Figure 4A:
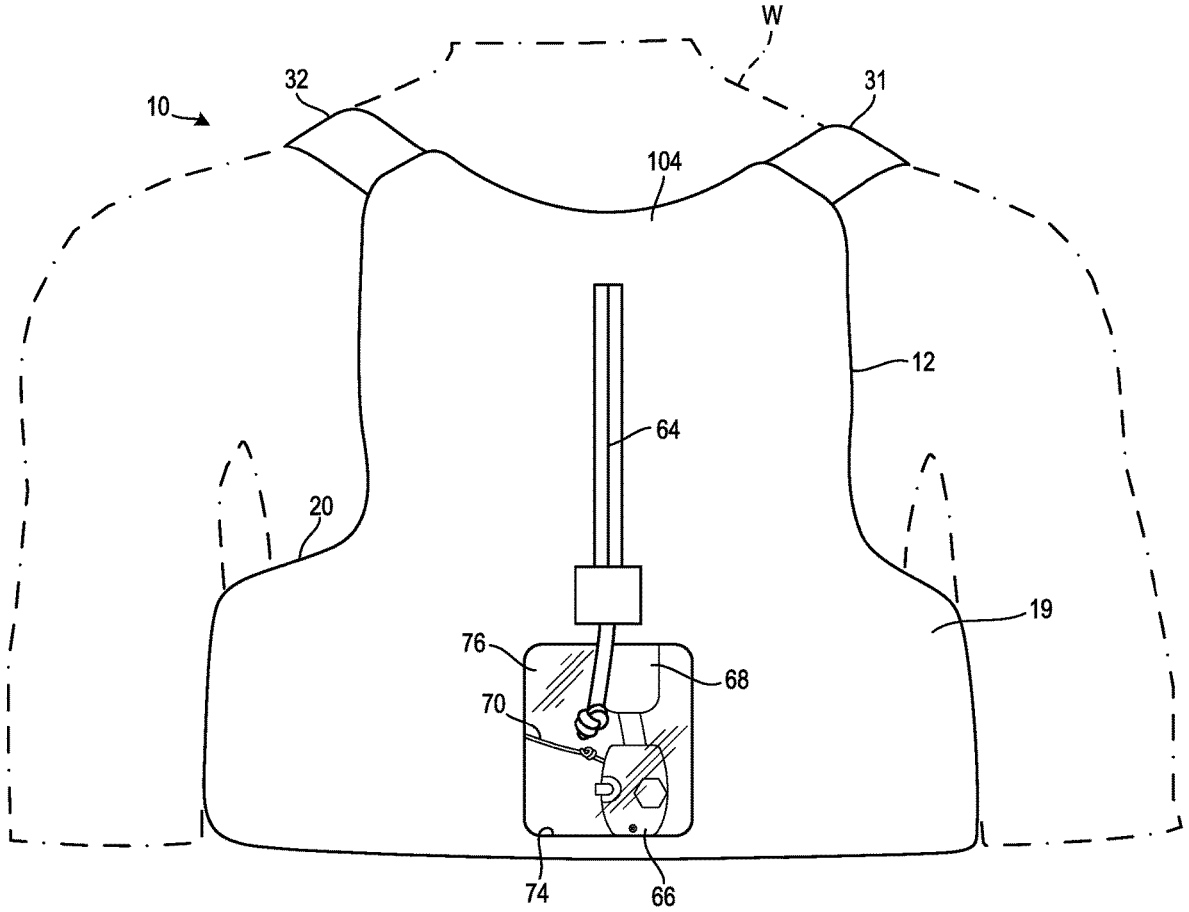
FIGS. 4A and 4B show a rear of the flotation device of FIGS. 1A and 1B in an as-worn, undeployed condition.
Figure 4B:
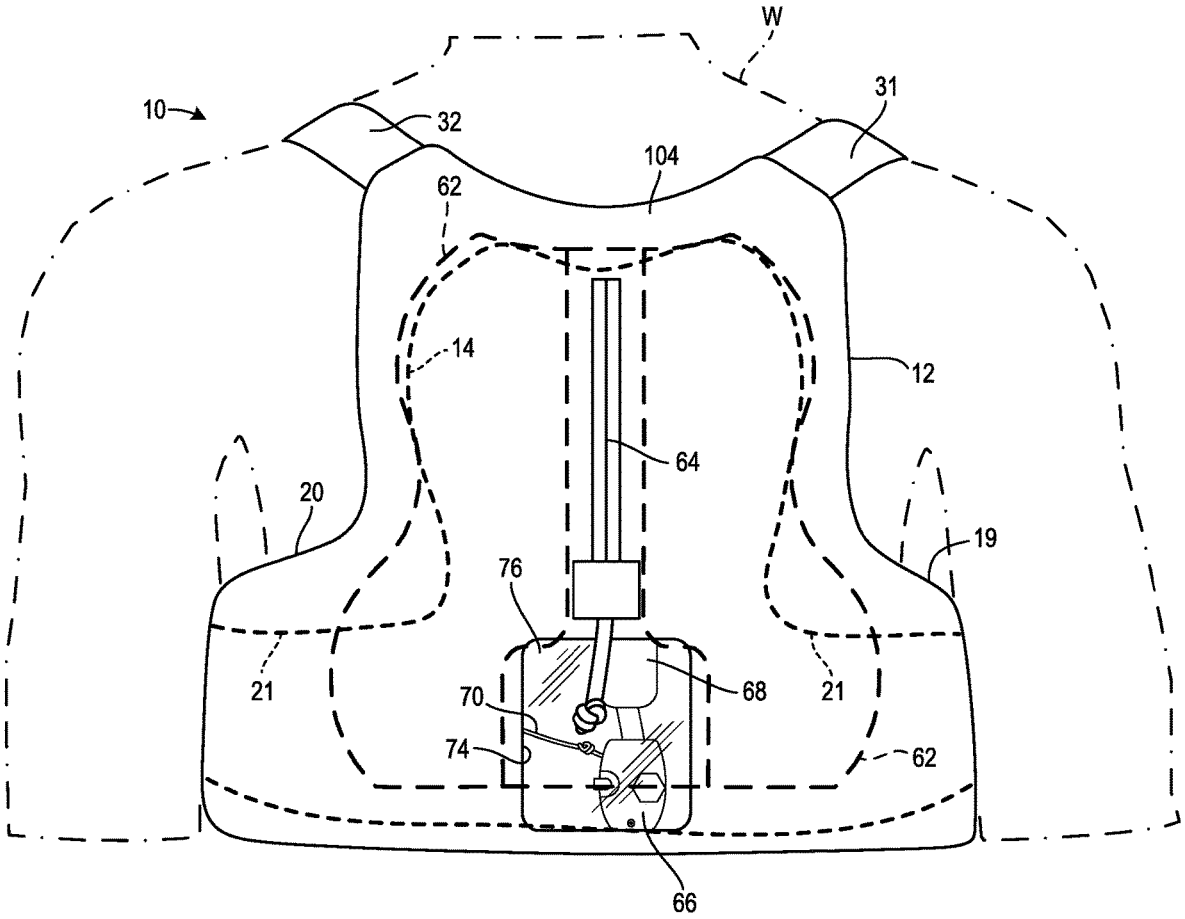

FIGS. 2A and 2B show a left view of the flotation device 10. FIG. 3 shows a front of the flotation device 10. FIGS. 4A and 4B show a rear of the flotation device 10. FIGS. 1A through 4B show the flotation device 10 in an undeployed condition. In the undeployed condition, a flotation bladder may be at least partially deflated (e.g., enough air may be removed to allow folding and stowage of the bladder) and stored in interiors of rear and side sections of the flotation device 10, as described in more detail below. In a deployed condition, and as described in connection with FIGS. 5 and 6, the bladder may be inflated and portions of the inflated bladder may extend outward from the side sections of the flotation device 10.

For ease of explanation, various elements of the flotation device 10 may described by reference to corresponding anatomical regions of the wearer W. An element of the flotation device 10 can be considered as corresponding to an anatomical region of a wearer's body if that element is generally located over that anatomical region when the undeployed vest is properly worn and secured such as shown in FIGS. 1A through 4B. As used herein, and unless context clearly indicates otherwise, "left," "right," "front," "rear," "top," "bottom," and other terms of direction or orientation assume the perspective of the wearer W.

As seen in FIG. 1A, the flotation device 10 comprises a rear section 12 and a right side section 15. A rear end 19 of the right side section 15 may be coupled to a lower portion of a right side of the rear section 12. The right side section 15 may extend forward from the rear end 19 to a front end 23. A right side strap system 27 may couple the rear section 12, at a right side of an upper portion of the rear section 12, to a portion of the right side section 15 between the rear end 19 and the front end 23. The right side strap system 27 may comprise a strap 31, attached to the rear section 12, and a strap 35, attached to the right side section 15, coupled by an adjustable buckle 39. A strap system need not comprise multiple straps. For example, a single strap extending from the rear section 12 may be coupled to a buckle attached directly to the right side section 15. A strap system need not be adjustable, and/or may comprise more than two straps. A strap system may comprise multiple other strap systems.

FIG. 1B shows, in broken lines, the approximate locations of portions of a bladder 13. A rear lobe 14 of the bladder 13, which is at least partially deflated in FIGS. 1A through 4B, is contained within the rear section 12. A right side lobe 17 of the bladder 13, which is at least partially deflated in FIGS. 1A through 4B, is folded and contained within the right side section 15. The bladder 13 may further comprise a connecting section 21 that connects the rear lobe 14, the right side lobe 17, and a left side lobe 18 (described below). Interiors of the connecting section 21, the rear lobe 14, the right side lobe 17, and the left side lobe 18 being in fluid communication with one another and with an inflator (described below in connection with FIG. 4B).

FIG. 2A, the flotation device 10 further comprises a left side section 16. The left side section 16 may, except as described below, be similar to the right side section 15. A rear end 20 of the left side section 16 may be coupled to a lower portion of a left side of the rear section 12. The left side section 16 may extend forward from the rear end 20 to a front end 24. A left side strap system 28 may couple the rear section 12, at a left side of the upper portion of the rear section 12, to a portion of the left side section 16 between the rear end 20 and the front end 24. The left side strap system 28 may comprise a strap 32, attached to the rear section 12, and a strap 36, attached to the left side section 16, coupled by an adjustable buckle 40. The left side section 16 also comprises an activation handle 26. The handle 26 may be attached to a lanyard, not visible in FIG. 2A, that extends through an opening in an outer surface of the left side section 16, and through an interior of the left side section 16 and an interior of the rear section 12, to an inflator, as described below. A retention patch 30 may comprise one or more elastic fabric panels that are stitched onto the left side section 16 to form a pocket to retain a portion of the handle 26 and keep the handle 26 close to the left side section 16 so as to reduce risk of snags, inadvertent deployment, etc.

FIG. 2B shows, in broken lines, the approximate locations of additional portions of the bladder 13. The left side lobe 18 of the bladder 13, which is at least partially deflated in FIGS. 1A through 4B, is folded and contained within the left side section 16. The connecting section 21, which is also at least partially deflated in FIGS. 1A through 4B, may be contained in a rear portion of the left side section 16, in a lower portion of the rear section 12, and in a rear portion of the right side section 15.

FIG. 3 shows the front end 23 of the right side section 15 and the front end 24 of the left side section 16. A front strap system 50 releasably couples the front end 23 to the front end 24. A strap 51, attached to an inside surface of the right side section 15, extends through a first set of adjustable slip lock buckle slots on a first part 52*a* of a side release buckle. A strap 54, attached to an inside surface of the left side section 16, extends through a second set of adjustable slip lock buckle slots on a second side 52*b* of the side release buckle.

Also visible in FIG. 3 are a right bladder release gap closure 57 and a left bladder release gap closure 58. The right bladder release gap closure 57 may comprise a nylon zipper, and in particular, may comprise a pair of tooth chains 59*a* and 59*b*. The tooth chain 59*a* may be attached to a fabric strip, and that fabric strip may be attached (e.g., stitched) to a first side of a right bladder release gap formed in the front end 23. A tooth chain 59*b* may be attached to a fabric strip, and that fabric strip may be attached (e.g., stitched) to a second side of the right bladder release gap. When the teeth of the tooth chains 59*a* and 59*b* are intermeshed, the edges of the right bladder release gap are held closed and retain the at least partially deflated and folded right side lobe 17 in the interior of the right side section 15. The zipper formed by the tooth chains 59*a* and 59*b* may lack a bridge stop or other connection between chains 59*a* and 59*b* on at least one end, or may otherwise be configured, so as to allow separation of the chains 59*a* and 59*b*, and opening of the right bladder release gap, when the right side lobe 17 is inflated (e.g., during inflation of the bladder 13). In particular, when the right side lobe 17 inflates, the force on the interior surfaces of the right side section 15, resulting from expansion of the right side lobe 17, is sufficient to pull apart the intermeshed tooth chains 59*a* and 59*b*. The inflating right side lobe 17 may then emerge through the opened right bladder release gap. An example of a zipper that may be configured for use as the release gap closures 57 and 58 is the QUICKBURST zipper available from YKK Corporation.

The left bladder release gap closure 58 may be similar to the closure 57, and may comprise tooth chains 60*a* and 60*b* of a nylon zipper. The tooth chains 60*a* and 60*b* may be attached to fabric strips, with those fabric strips attached (e.g., stitched) to opposite sides of left bladder release gap formed in the front end 24. When the teeth of the tooth chains 60*a* and 60*b* are intermeshed, the edges of the left bladder release gap are held closed and retain the at least partially deflated and folded left side lobe 18 in the interior of the left side section 16. The zipper formed by the tooth chains 60*a* and 60*b* may lack a bridge stop or other connection between the chains 60*a* and 60*b* on at least one end, or may otherwise be configured, so as to allow separation of those tooth chains, and opening of the left bladder release gap, when the left side lobe 18 is inflated (e.g., during inflation of the bladder 13). Similar to the right side lobe 17, the force on the interior surfaces of the left side section 16, resulting from expansion of the left side lobe 18, is sufficient to pull apart the intermeshed tooth chains 60*a* and 60*b*. The inflating left side lobe 18 may then emerge through the opened left bladder release gap.

Because zippers may be non-destructively opened and then mechanically reclosed without specialized tools, repacking of the right side lobe 17 in the right side section 15 and the left side lobe 18 in the left side section 16 may be simplified and performed in the field. Other types of non-destructively detachable and mechanically re-attachable release closures may also or alternatively be used. For example, hook and loop fastener material could be used to hold the bladder release gaps closed and to allow opening of those gaps as the bladders inflate. A strip of hook material may be attached to a first side of each of the bladder release gaps, and a strip of loop material may be attached to a second side of each of the bladder release gaps. As another example, snaps could used to hold the bladder release gaps closed and to allow opening of those gaps as the bladders inflate. One or more snap sockets may be attached to a first side of each of the bladder release gaps, and corresponding studs may be attached to a second side of each of the bladder release gaps. As but another example, magnetic fasteners could used to hold the bladder release gaps closed and to allow opening of those gaps as the bladders inflate. One or more magnets may be attached to a first side of each of the bladder release gaps, and corresponding magnetically-attracted ferrous plates may be attached to a second side of each of the bladder release gaps. As yet a further example, press seal closures could be used. A first part of each such closure, which may comprise a strip with a ridge, may be attached to a first side of each of the bladder release gaps. A second part of each such closure, which may comprise a strip with a channel sized to receive and hold an edge of the ridge, may be attached to a second side of each of the bladder release gaps.

Although non-destructively openable and mechanically closable release closures may be used, bladder release gaps may also or alternatively be held closed by structures that require tearing and/or other destructive action during gap opening. For example, sides of the release gaps may be sewn together using a lightweight thread sized to part under loads resulting from bladder expansion. As another example, after packing of the bladder lobes, a sheet of lightweight plastic film or other material may glued in place to cover the front ends of the side sections. The material covering the front ends may be selected to have a rupture strength that will yield in response to the force of inflating bladder lobes.

As also seen in FIG. 3, the left strap system 27, the right strap system 28, and the front strap system 50 may allow simple adaptation of the flotation device 10 to a wide range of wearer body sizes and shapes. The left strap system 27 and the right strap system 28 may be shortened so that the floatation device 10 will snugly fit a shorter individual, or lengthened so that the floatation device 10 will snugly fit a taller individual. The front strap system 50 may be shortened so that the floatation device 10 will snugly fit an individual of smaller stature, or lengthened so that the flotation device 10 will snugly fit an individual of larger stature. Because the rest of the flotation device 10 is positioned at the wearer's sides and over wearer's back, movement of the wearer is not significantly affected when wearing the undeployed flotation device 10. Moreover, the flotation device 10 has a minimal presence in the wearer's chest and front abdominal regions. This reduces interference with other equipment (e.g., a reserve parachute, an equipment pack, a weapon, etc.) that the wearer may be carrying over his or her chest and/or front abdominal regions.

FIG. 4A shows additional details of the rear section 12. The rear section 12 may extend over portions of scapular regions (over portions of the shoulder blades) of the wearer W, over an interscapular region of the wearer W between the shoulder blades, and over infrascapular regions of the wearer W under the shoulder blades. An end of the strap 32 may be attached to an upper left portion of the rear section 12, and an end of the strap 31 may be attached to an upper right portion of the rear section 12. An upper portion of the rear section 12 between the attachments of the straps 31 and 32 may be scalloped to reduce discomfort and/or to reduce restriction of movement of the wearer W.

FIG. 4B shows, in broken lines, the approximate locations within the rear section 12 of the rear lobe 14 and of a portion of the connecting section 21. FIG. 4B also shows, with larger broken lines, the approximate location within the rear section 12 of a closed-cell foam panel 62. The panel 62, which may be contained within the interior of the rear section 12, may provide supplemental flotation, may provide support, may help stabilize the device 10, may increase wearer comfort. A front portion of the panel 62 may be bonded to an interior side of a fabric panel forming a front portion of the rear section 12. A rear portion of the panel 62 may be attached to the front portion of the panel 62. The panel 62 may alternately be a formed as single piece or as more than two pieces, and/or may comprise multiple unattached pieces. A zipper 64 may be opened to expose the interior of the rear section 12 and the panel 62.

Also visible in FIGS. 4A and 4B are an inflator 66 and an attached compressed gas canister 68. Inflators and gas canisters are well-known components and commercially available. An end of a lanyard 70 may be connected to an actuation lever of the inflator 66. The opposite end of the lanyard 70 may be connected to the handle 26 (see FIGS. 2A and 2B). When the wearer W pulls the handle 26, tension on the lanyard 70 pulls the actuation lever and causes a seal of the gas canister 68 to be breached. Gas then flows from the gas canister 68, through the inflator 66 and into the rear lobe 14, the connecting section 21, the right side lobe 17, and the left side lobe 18 to inflate the bladder 13.

A portion of an outer panel 104 (discussed below in connection with FIG. 8) corresponding to the rear section 12 may include a cutout 74. The inflator 66 and a portion of the gas canister 68 may be within the area of the cutout 74. A panel 76 of clear plastic or other transparent material may cover the cutout 74. The window formed by the cutout 74 and the panel 76 allows the inflator 66 and the portion of the gas canister 68 to be visible from an exterior of the flotation device 10. This allows confirmation, without needing to open the zipper 64 or otherwise access the interior of the rear section 12, that a safety switch 78 (or other arming mechanism) is in the desired configuration, that the gas canister 68 is installed, and/or that the lanyard 70 is properly attached. The inflator 66 and/or the gas canister 68 may, if necessary, be accessed via an opening formed by unzipping the zipper 64.

Figure 5:
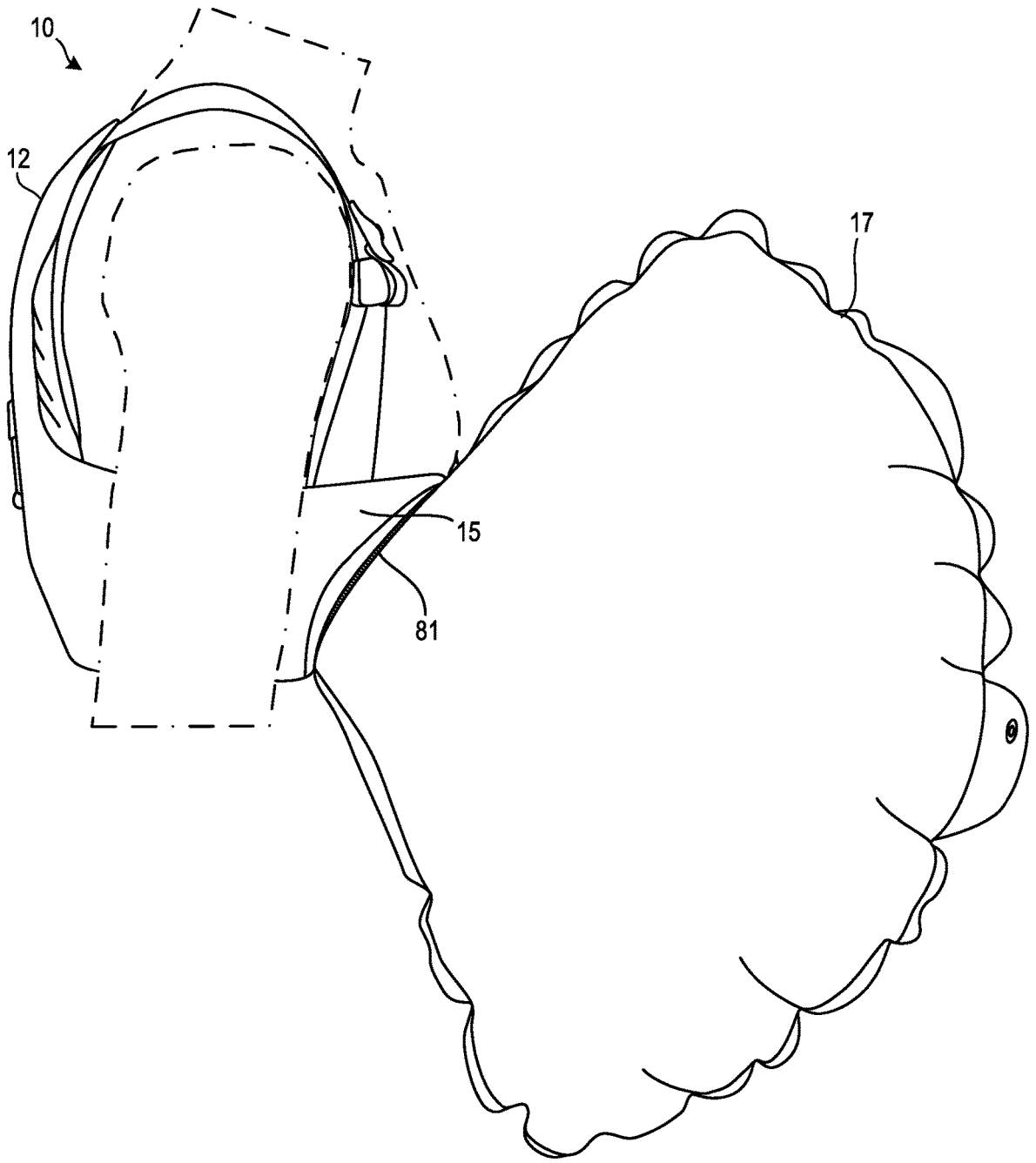
FIG. 5 shows a right side of the flotation device of FIGS. 1A and 1B in an as-worn, deployed condition.

FIG. 5 is a right side view of the flotation device 10 in an as-worn, deployed condition. The bladder 13 has inflated and the right side lobe 17 has expanded from the right side section 15 via the right bladder release gap 81.

Figure 6:
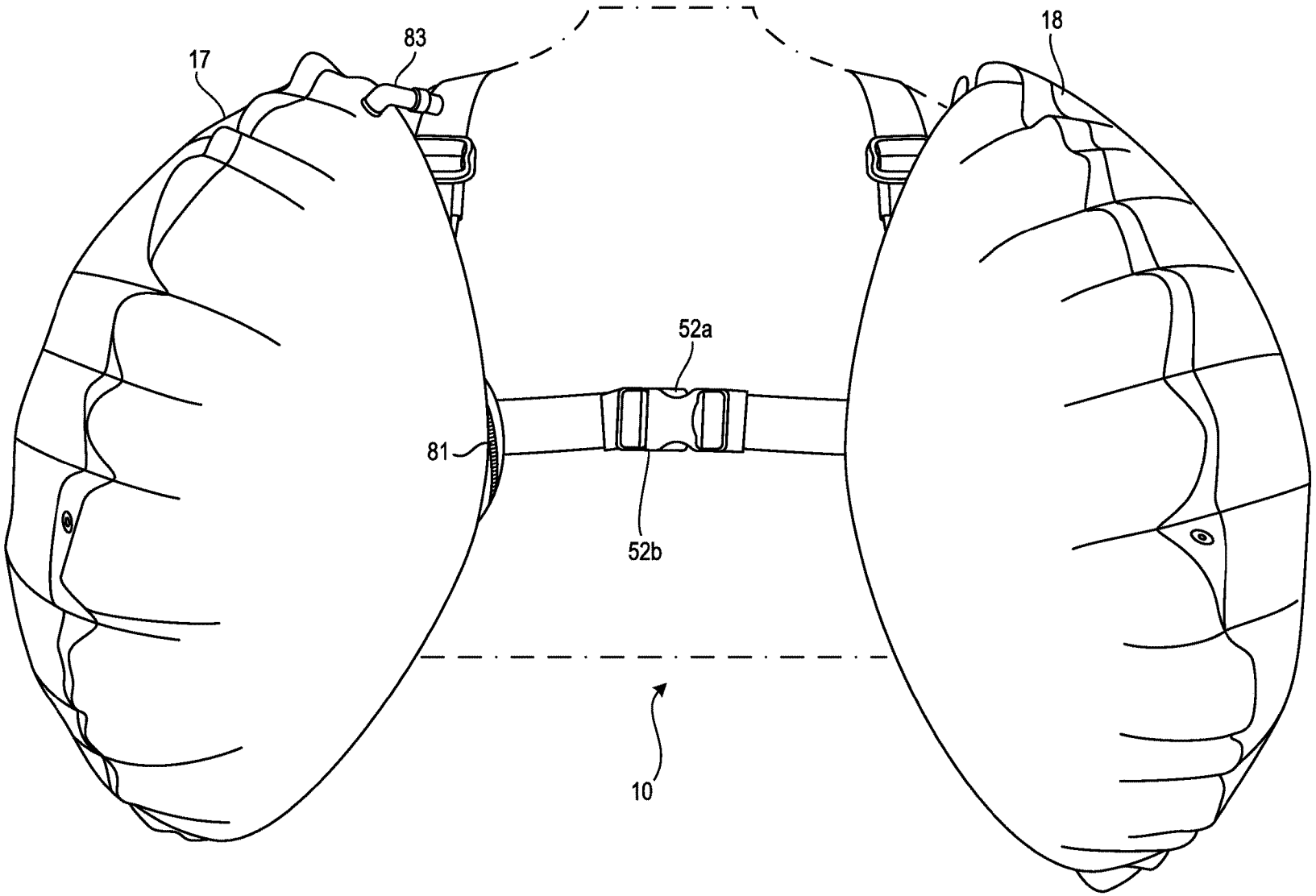
FIG. 6 shows a front of the flotation device of FIGS. 1A and 1B in an as-worn, deployed condition.

FIG. 6 is a front view of the flotation device 10 in the as-worn, deployed condition. Similar to the right side lobe 17, the left side lobe 18 has also deployed. In particular, the inflation of the bladder 13 has caused the left side lobe 18 to expand from the left side section 16 via a left bladder release gap. The left bladder release gap is obscured by the left side lobe 18 in FIG. 6, but may have a configuration similar to that of the right bladder release gap 81. The right side lobe 17 may include a manual inflation tube 83. The left side lobe 18 may, if desired, may also or alternatively comprise a similar manual inflation tube. In the event of a malfunction of the inflator 66, a break of the lanyard 70, or other problem, the wearer W may manually open the right bladder release gap 81 and/or the left bladder release gap, manually pull the right side lobe 17 from the right side section 15 and/or manually pull the left side lobe 18 from the left side section 16, and inflate the bladder 13 by blowing into the tube 83. The right side bladder release gap closure 57 may comprise a tab or other member to allow manual opening of the closure 57. The left side bladder release gap closure 58 may comprise a similar tab or other member.

Figure 7:
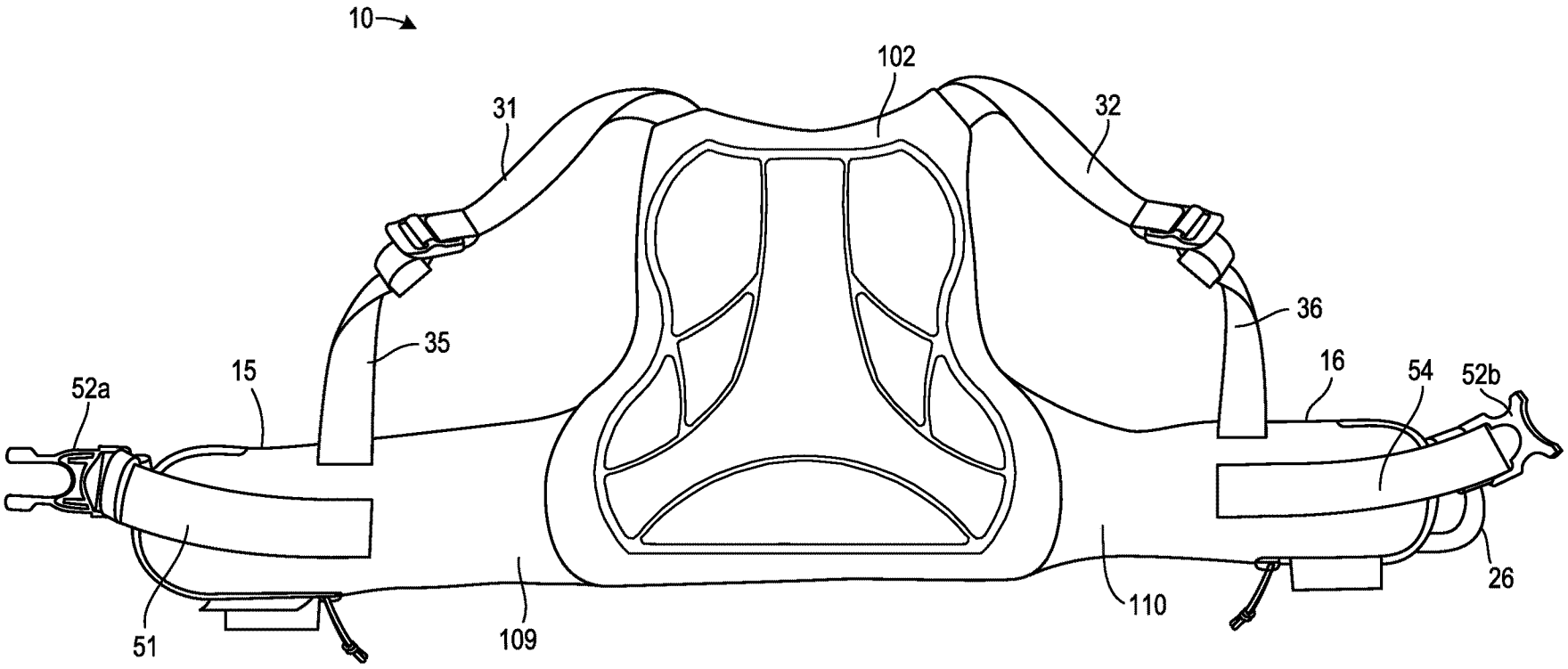
FIG. 7 shows an inner face of the flotation device of FIGS. 1A and 1B in an unworn, undeployed, and laid-flat condition.
Figure 8:
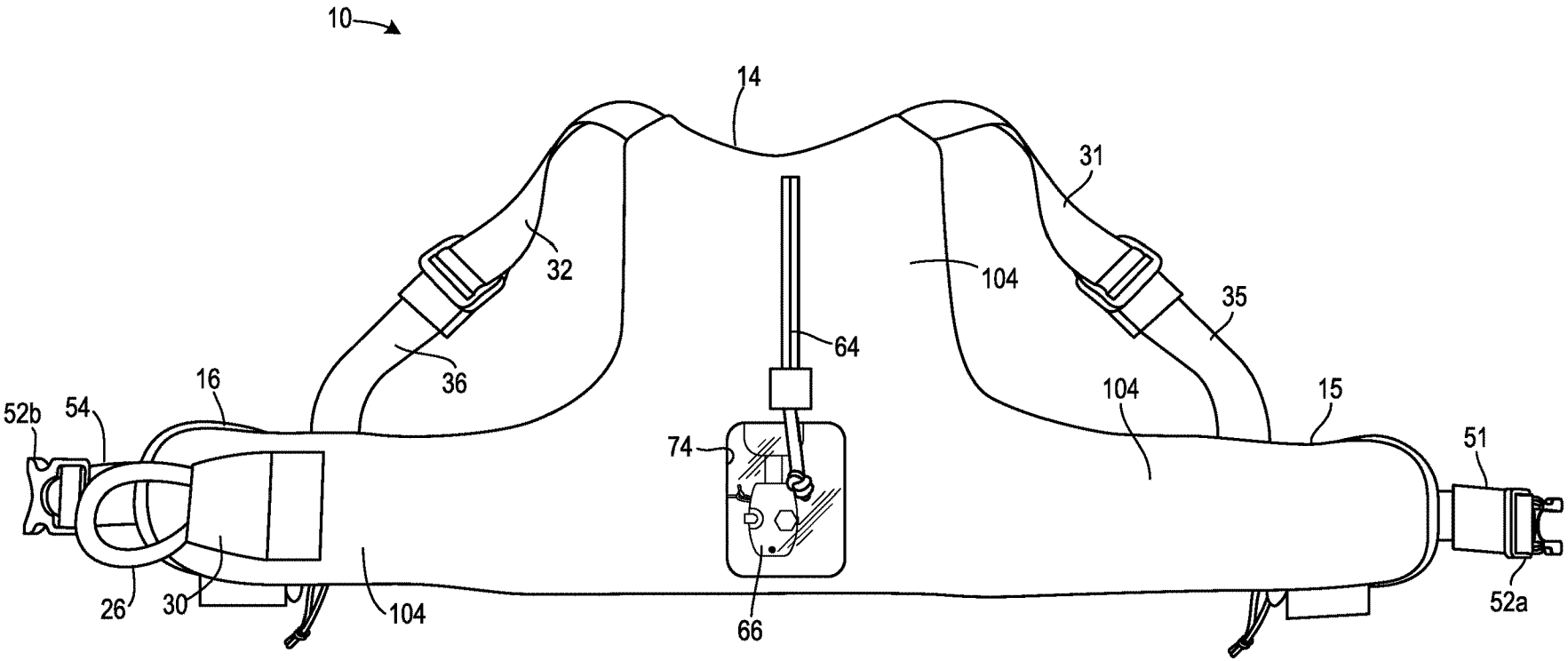
FIG. 8 shows an outer face of the flotation device of FIGS. 1A and 1B in an unworn, undeployed, and laid-flat condition.

FIG. 7 shows an inner face of the flotation device 10 in an unworn and undeployed configuration. In FIG. 7, the buckle 52*a*/52*b* has been released and the flotation device 10 has been laid flat to expose surfaces of the rear section 12, the right side section 15, and the left side section 16 that face the wearer W in FIGS. 1 through 6. FIG. 8 shows an outer face of the flotation device 10 in an unworn and undeployed configuration. In FIG. 8, the buckle 52*a*/52*b* has been released and the flotation device 10 has been laid flat to expose surfaces of the rear section 12, the right side section 15, and the left side section 16 that face away from the wearer Win FIGS. 1 through 6.

As seen in FIG. 7, the flotation device 10 may comprise an inner panel 102 that forms an inner face of the rear section 12, an inner panel 109 that forms an inner face of the right side section 15, and an inner panel 110 that forms an inner face of the left side section 16. Joints between the panels 102 and 109 and between the panels 102 and 110 may be reinforced. The portion of the flotation device 10 formed by the panels 102, 109, and 110 may alternately be formed from a single panel of material or may be formed from other combinations of multiple panels of material that have been joined together. As seen in FIG. 8, the flotation device 10 may comprise an outer panel 104 that forms an outer face of the rear section 12, an outer face of the right side section 15, and an outer face of the left side section 16. The outer panel 104 may be formed from a single panel of material or may be formed from multiple panels of material that have been joined together. Top and bottom edges of the portion of the panel 104 corresponding to the right side section 15 may be stitched or otherwise joined to top and bottom edges of the panel 109 to partially enclose the interior of the right side section 15. Top and bottom edges of the portion of the panel 104 corresponding to the left side section 16 may be stitched or otherwise joined to top and bottom edges of the panel 110 to partially enclose the interior of the left side section 16. The right bladder release gap closure 57 may be attached to the front of the portion of the panel 104 corresponding to the right side section 15 and to the front of the panel 109. The left bladder release gap closure 58 may be attached to the front of the portion of the panel 104 corresponding to the left side section 15 and to the front of the panel 109.

Figure 9:
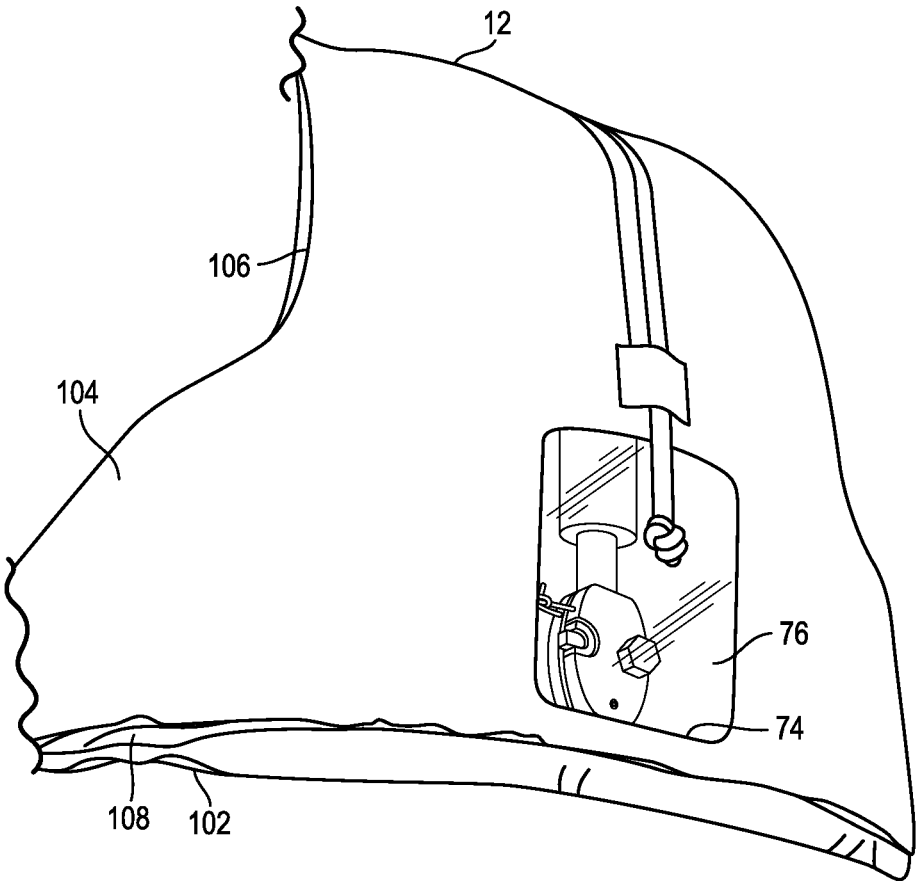
FIG. 9 is a bottom perspective view of the rear section of the flotation device of FIGS. 1A and 1B.

To form the rear section 12, a top portion of the panel 104 corresponding to the rear section 12 may stitched or otherwise joined to a top portion of the panel 102. Additional expansion panels may then be attached between other edges of the panels 102 and 104. As seen in FIG. 1, a right side expansion panel 105 is attached to, and spans, right side edges of the panel 102 and the portion of the panel 104 corresponding to the rear section 12. As seen in FIG. 2, a left side expansion panel 106 is attached to, and spans, left side edges of the portions of the panel 102 and the portion of the panel 104 corresponding to the rear section 12. As seen in FIG. 9, a bottom perspective view of the rear section 12 with the left side section 16 and other components omitted, a bottom expansion panel 108 is attached to, and spans, bottom edges of the panel 102 and the portion of the panel 104 corresponding to the rear section 12. The expansion panels 105, 106, and 108 allow the shape of the rear section to adapt to inflation of the bladder 13.

The expansion panels 105, 106, and 108 may be formed from an elastic material such as a woven nylon elastomer. The panels 102, 104, 109, and 110 may be formed from one or more materials such as, for example, single ply or laminated nylon cloth. An example of material that may be used for the panels 102, 104, 109, and 110 is CORDURA nylon. The straps of the strap systems 27, 28, and 50 may be formed from nylon webbing.

Figure 10:
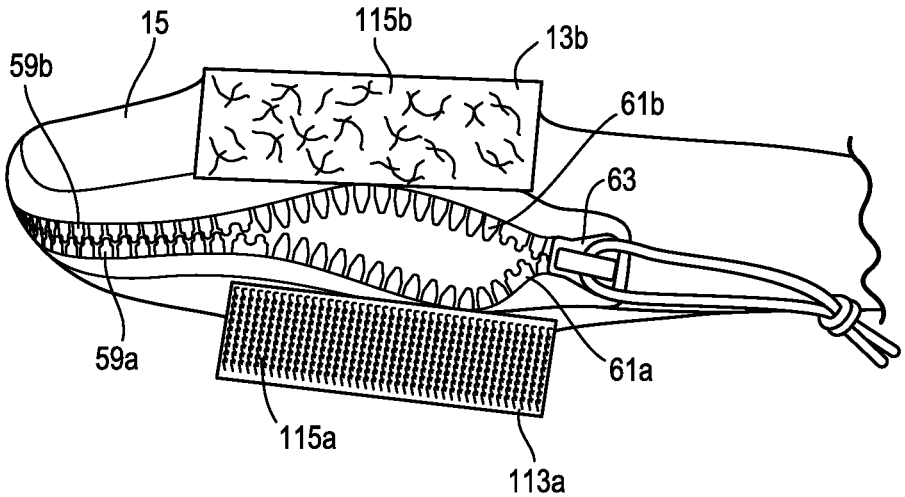
FIG. 10 shows additional details of a closure of the flotation device of FIGS. 1A and 1B.

FIG. 10 shows additional details of the right bladder release gap closure 57. The tooth chains 59*a* and 59*b* include portions 61A and 61*b* configured to easily separate in response to tension. A slider 63 may be used, when packing the right side lobe 17 into the right side section 15, to mesh the tooth chains 59*a* and 59*b*. Supplemental tabs 113*a* and 113*b* may respectively comprise a panel 115*a* of hook and a panel 115*b* of pile and may be used to prevent inadvertent separation of the tooth chains 59*a* and 59*b*. The left bladder release gap closure 58 have a similar structure and include similar supplemental tabs.

Figure 11:
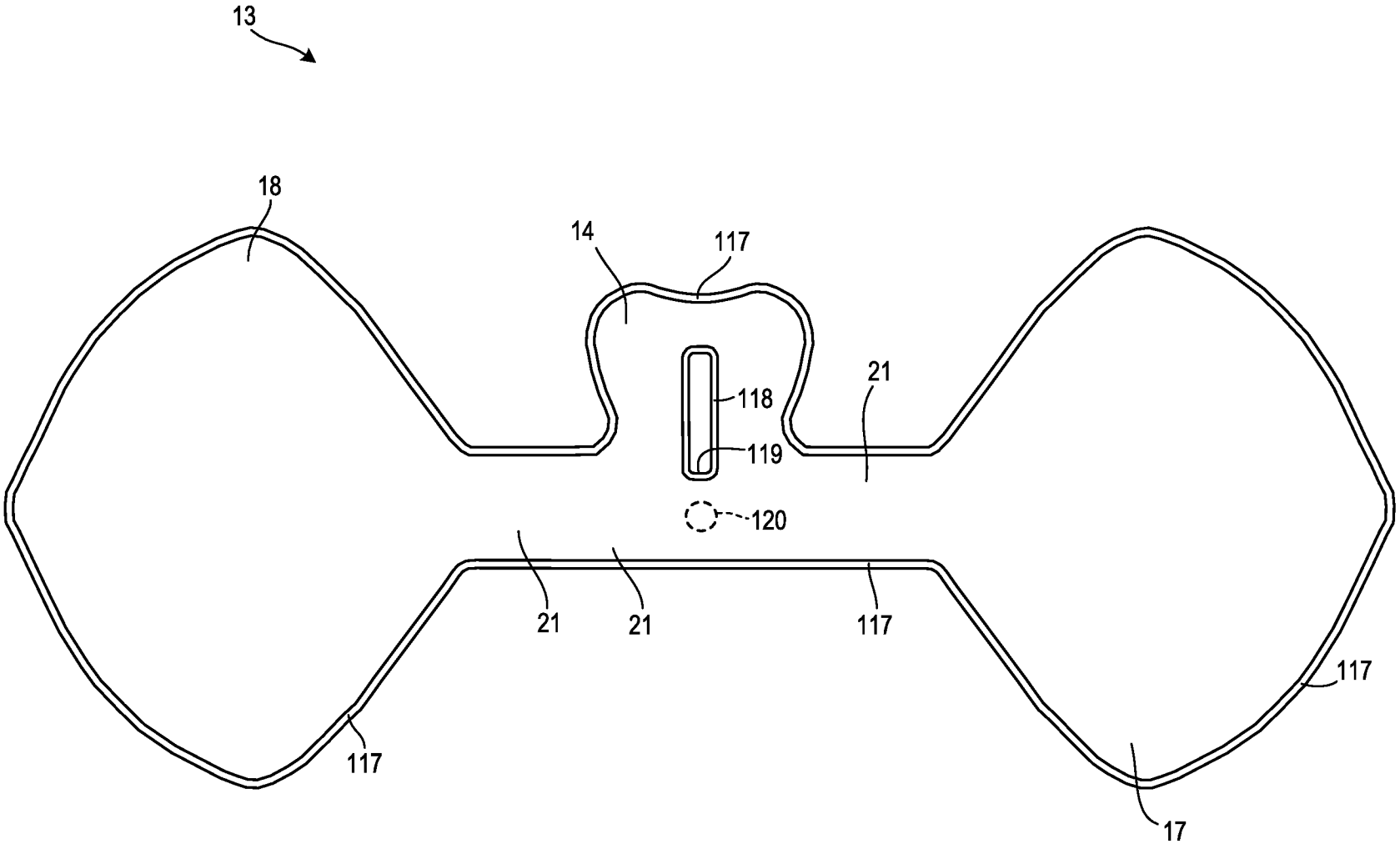
FIG. 11 shows, in a deflated and laid-flat condition, the bladder of the flotation device of FIGS. 1A and 1B.

FIG. 11 shows the bladder 13, in a deflated and laid-flat condition, removed from the flotation device 10. A location 120 of attachment of the inflator 66 is indicated, although the inflator 66 and the gas canister 68 are not shown. The bladder 13 may be formed from two sheets of urethane coated nylon cloth that have been bonded around an outer edge 117 and around the edge 118 of a cutout 119. The cutout 119 may be included, for example, to prevent the rear lobe 14 from becoming too large after inflation and/or to accommodate the gas canister 68. The bladder 13 may be installed by opening the zipper 64, inserting the right side lobe 17 into the interior of the right side section 15, inserting the left side lobe 18 into the interior of the left side section 16, and by arranging the rear lobe 14 and the center part of the connecting portion 21 in the rear section 12. The bladder 13 need not be bonded or otherwise attached to the interior of the flotation device 10. Once the zipper 64 is closed, the shape of the bladder 13 maintains the bladder in the desired position while allowing for some internal movement (e.g., to prevent binding). The flotation device 100 may, after inflation of the bladder 13, provide buoyancy of at least 100 pounds in saltwater.

Figure 12A:
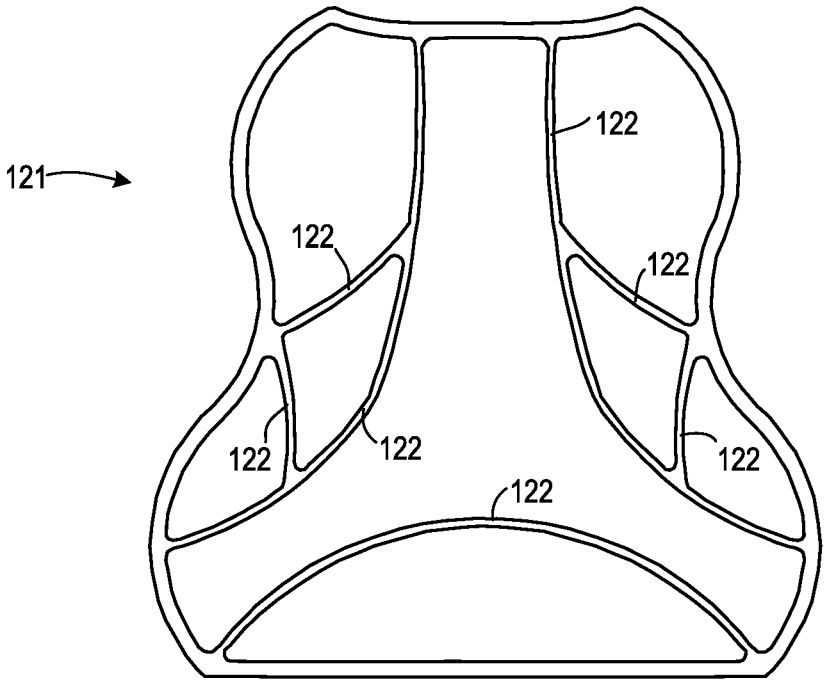
FIGS. 12A and 12B are respective plan and edge views of a front portion of a closed cell foam element of the flotation device of FIGS. 1A and 1B.
Figure 12B:
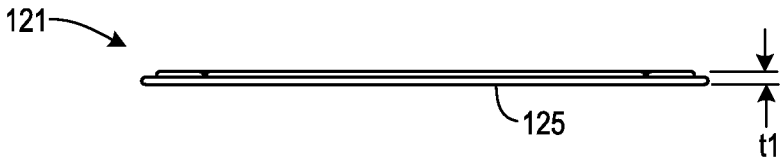
Figure 13A:
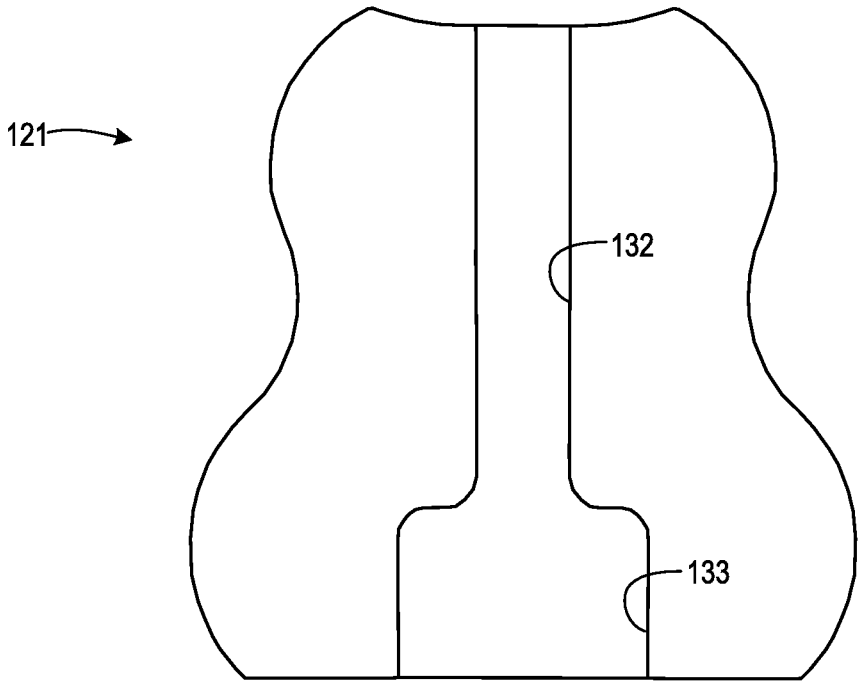
FIGS. 13A and 13B are respective plan and edge views of a rear portion of the closed cell foam element of the flotation device of FIGS. 1A and 1B.
Figure 13B:
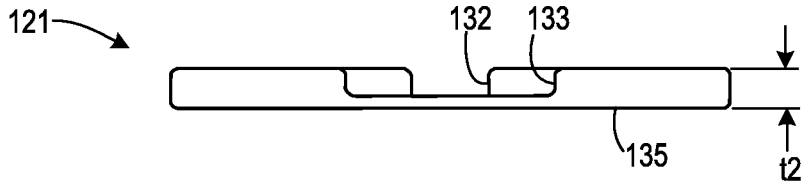

FIGS. 12A and 12B are respective plan and edge views of a front portion 121 of the closed cell foam panel 62. FIG. 12A shows the side of the front portion 121 that may be bonded to an interior surface of the panel 102. The front portion 121 may comprise raised sections separated by channels 122. The channels 122 may allow increased flexibility, breathability, and wearer comfort. The front portion 121 may be heat pressed, or directly molded onto, the panel 102 so that panel 102 conforms to the channels 122, as shown in FIG. 7. The front portion 121 may have a thickness of, for example 0.25 inches. A rear face 125 of the front portion 121 is indicated in FIG. 13B FIGS. 13A and 13B are respective plan and edge views of a rear portion 131 of the closed cell foam panel 62. FIG. 13A shows the side of the rear portion 131 that may face toward the interior surface of the portion of the panel 104 corresponding to the rear section 12. A channel 132 and widened region 133 may be formed to accommodate the inflator 66 and the gas canister 68. A front face 135 of the rear portion 131, shown in FIG. 13B, may be glued or otherwise bonded to the rear face 125 of the front portion 121. Any of various types of closed-cell foam (e.g., polyvinyl chloride foam, polyethylene foam) may be used for the front portion 121 and the rear portion 131. The closed cell foam panel 62 may have of thickness of, for example, 1 inch (e.g., t1 may be 0.25 inches and t2 may be 0.75 inches)

The flotation device 10 may offer various advantages over other types of flotation devices. As seen in FIGS. 5 and 6, the lobes 17 and 18 expand outward from the front of the wearer W. This provides buoyancy but avoids restricting arm movement of the wearer W. The structure of the rear section 12, the side sections 15 and 16, and the strap system comprising the strap systems 27, 28, and 50 secures the inflated bladder 13 in position and provides stability. The shape of the rear section 12 is low profile and may be worn under a parachute. Prior to deployment, lobes 17 and 18 of the bladder 13 are held in the side sections 15 and 16, which are below armpit level and avoid interfering with equipment carried over the front of the wearer W.

The flotation device 10 may provide buoyancy, from the inflated bladder 13 and the closed cell foam panel 62, of at least 100 pounds (in salt water). The flotation device 10 may be configured for wear by individuals within a particular size range. The flotation device 10 may, for example, be configured for wear by a male or female having a height range between 58 inches and 80 inches. As indicated above, the strap systems 27, 28, and 50 permit adaptation to a wide range of body sizes and shapes. Also or alternatively, the flotation device 10 may be fabricated in multiple sizes, with each of those multiple sizes being configured for wear by individuals having heights in smaller ranges (e.g., a range of 58 inches to 65 inches, a range of 65 inches to 72 inches, a range of 72 inches to 80 inches).

Flotation devices according to this disclosure may comprise numerous variations on some or all of the above-described features. Other materials may be used for some or all components. Shapes and/or orientations of one or more features may be modified.

Various components are described herein as coupled. Components may be coupled by direct attachment to one another, or may be coupled via attachment to one or more intermediate components. Two components may be non-destructively or destructively detachable. Examples of non-destructive detachment include unzipping a zipper, unbuckling a buckle, removing a strap from slip lock buckle slots, etc. Examples of destructive detachment include cutting or tearing stitches or material.

The foregoing has been presented for purposes of example. The foregoing is not intended to be exhaustive or to limit features to the precise form disclosed. The examples discussed herein were chosen and described in order to explain principles and the nature of various examples and their practical application to enable one skilled in the art to use these and other implementations with various modifications as are suited to the particular use contemplated. The scope of this disclosure encompasses, but is not limited to, any and all combinations, subcombinations, and permutations of structure, operations, and/or other features described herein and in the accompanying drawing figures.

The invention claimed is:

1. A wearable personal flotation device comprising:
- a rear section;
- a right side section coupled to, and extending forward from, a lower right side of the rear section;
- a left side section coupled to, and extending forward from, a lower left side of the rear section;
- a strap system configured to couple an upper part of the rear section to the left side section and to the right side section and to couple the left side section to the right side section;
- an inflatable bladder comprising a right side lobe and a left side lobe;
- an inflator, positioned in the rear section, in fluid communication with the bladder;
- a gas canister attached to the inflator; and
- a transparent panel, in the rear section, exposing the inflator, wherein:
- the right side lobe is at least partially deflated, is contained in an interior of the right side section, and is configured to expand, during inflation, through a right bladder release gap in a front end of the right side section, and
- the left side lobe is at least partially deflated, is contained in an interior of the left side section, and is configured to expand, during inflation, through a left bladder release gap in a front end of the left side section.

2. The wearable personal flotation device of claim 1, wherein the strap system comprises:
- a front strap system configured to releasably couple the front end of the left side section to the front end of the right side section;
- a left side strap system coupled to the upper part of the rear section and to the left side section; and
- a right side strap system coupled to the upper part of the rear section and to the right side section.

3. The wearable personal flotation device of claim 1, wherein the rear section comprises a panel of buoyant closed cell foam.

4. The wearable personal flotation device of claim 1, wherein the rear section is configured to cover at least portions of interscapular and infrascapular regions of a wearer of the device.

5. The wearable personal flotation device of claim 1, wherein the left bladder release gap is configured to remain closed until opened by expansive force imposed by inflation of the left side lobe, and wherein the right bladder release gap is configured to remain closed until opened by expansive force imposed by inflation of the right side lobe.

6. The wearable personal flotation device of claim 1, wherein the rear section comprises a front panel, a rear panel, a left side expansion panel joined to a left side edge of the front panel and to a left side edge of the rear panel, and a right side expansion panel joined to a right side edge of the front panel and to a right side edge of the rear panel.

7. The wearable personal flotation device of claim 6, wherein the rear section comprises a bottom expansion panel joined to a bottom edge of the front panel and to a bottom edge of the rear panel.

8. The wearable personal flotation device of claim 1, wherein the inflatable bladder comprises a rear lobe, contained in an interior of the rear section, and a connecting section joining the right side lobe, the left side lobe, and the rear lobe.

9. The wearable personal flotation device of claim 1, wherein the flotation device is configured to provide, after inflation of the bladder, a buoyancy of at least 100 pounds in saltwater.

10. A wearable personal flotation device comprising:
- a rear section comprising a panel of closed cell foam;
- a right side section coupled to, and extending forward from, a lower right side of the rear section;
- a left side section coupled to, and extending forward from, a lower left side of the rear section;

a strap system configured to couple an upper part of the rear section to the left side section and to the right side section and to couple the left side section to the right side section; and an inflatable bladder, wherein the bladder is at least partially deflated and contained in the right side section, the rear section, the left side section, and the bladder is configured to expand, during inflation, through a right bladder release gap in a front end of the right side section and through a left bladder release gap in a front end of the left side section.

11. The wearable personal flotation device of claim 10, wherein the strap system comprises:

a front strap system configured to releasably couple the front end of the left side section to the front end of the right side section;

a left side strap system coupled to the upper part of the rear section and to the left side section; and a right side strap system coupled to the upper part of the rear section and to the right side section.

12. The wearable personal flotation device of claim 10, wherein the rear section is configured to cover at least portions of interscapular and infrascapular regions of a wearer of the device.

13. The wearable personal flotation device of claim 10, wherein the left bladder release gap is configured to remain closed until opened by expansive force imposed by inflation of the bladder, and wherein the right bladder release gap is configured to remain closed until opened by expansive force imposed by inflation of the bladder.

14. The wearable personal flotation device of claim 10, further comprising:

an inflator, positioned in the rear section, in fluid communication with the bladder;

a gas canister attached to the inflator; and a transparent panel, in the rear section, exposing the inflator.

15. The wearable personal flotation device of claim 10, wherein the rear section comprises a front panel, a rear panel, a left side expansion panel joined to a left side edge of the front panel and to a left side edge of the rear panel, a right side expansion panel joined to a right side edge of the front panel and to a right side edge of the rear panel, and a bottom expansion panel joined to a bottom edge of the front panel and to a bottom edge of the rear panel.

16. A wearable personal flotation device comprising:

a rear section comprising a front panel, a rear panel, a bottom expansion panel joined to a bottom edge of the front panel and to a bottom edge of the rear panel, a left side expansion panel joined to a left side edge of the front panel and to a left side edge of the rear panel, and a right side expansion panel joined to a right side edge of the front panel and to a right side edge of the rear panel;

a right side section coupled to, and extending forward from, a lower right side of the rear section;

a left side section coupled to, and extending forward from, a lower left side of the rear section;

a strap system configured to couple an upper part of the rear section to the left side section and to the right side section and to couple the left side section to the right side section;

an inflatable bladder, wherein the bladder is at least partially deflated and contained in the right side section, the rear section, the left side section, and the bladder is configured to expand, during inflation, through a right bladder release gap in a front end of the right side section and through a left bladder release gap in a front end of the left side section.

17. The wearable personal flotation device of claim 16, further comprising:

an inflator, positioned in the rear section, in fluid communication with the bladder;

a gas canister attached to the inflator; and a transparent panel, in the rear section, exposing the inflator.

18. The wearable personal flotation device of claim 16, wherein the rear section is configured to cover at least portions of interscapular and infrascapular regions of a wearer of the device.

19. The wearable personal flotation device of claim 16, wherein the rear section comprises a panel of buoyant closed cell foam.

20. A wearable personal flotation device comprising:

a rear section;

a right side section coupled to, and extending forward from, a lower right side of the rear section;

a left side section coupled to, and extending forward from, a lower left side of the rear section;

a strap system configured to couple an upper part of the rear section to the left side section and to the right side section and to couple the left side section to the right side section; and an inflatable bladder comprising a right side lobe and a left side lobe, wherein:

the right side lobe is at least partially deflated, is contained in an interior of the right side section, and is configured to expand, during inflation, through a right bladder release gap in a front end of the right side section, the left side lobe is at least partially deflated, is contained in an interior of the left side section, and is configured to expand, during inflation, through a left bladder release gap in a front end of the left side section, and the rear section comprises a front panel, a rear panel, a left side expansion panel joined to a left side edge of the front panel and to a left side edge of the rear panel, and a right side expansion panel joined to a right side edge of the front panel and to a right side edge of the rear panel.

21. The wearable personal flotation device of claim 20, wherein the strap system comprises:

a front strap system configured to releasably couple the front end of the left side section to the front end of the right side section;

a left side strap system coupled to the upper part of the rear section and to the left side section; and a right side strap system coupled to the upper part of the rear section and to the right side section.

22. The wearable personal flotation device of claim 20, wherein the rear section comprises a panel of buoyant closed cell foam.

23. The wearable personal flotation device of claim 20, wherein the rear section is configured to cover at least portions of interscapular and infrascapular regions of a wearer of the device.

24. The wearable personal flotation device of claim 20, wherein the left bladder release gap is configured to remain closed until opened by expansive force imposed by inflation of the left side lobe, and wherein the right bladder release gap is configured to remain closed until opened by expansive force imposed by inflation of the right side lobe.

25. The wearable personal flotation device of claim 20, further comprising:

an inflator, positioned in the rear section, in fluid communication with the bladder;

a gas canister attached to the inflator; and a transparent panel, in the rear section, exposing the inflator.

26. The wearable personal flotation device of claim 20, wherein the rear section comprises a bottom expansion panel joined to a bottom edge of the front panel and to a bottom edge of the rear panel.

* * * * *